United States Patent [19]

Morris, Jr.

[11] 4,385,428

[45] May 31, 1983

[54] DRIVING APPARATUS

[76] Inventor: John S. Morris, Jr., 115 E. 8th St., Monroe, Mich. 48161

[21] Appl. No.: 182,027

[22] Filed: Aug. 28, 1980

[51] Int. Cl.[3] ..... E04D 15/00; B25D 1/00

[52] U.S. Cl. ..... 29/402.01; 29/432; 227/147; 227/153

[58] Field of Search ..... 29/402.01, 402.19, 432; 52/514, 747, 749; 227/147, 156

[56] References Cited

U.S. PATENT DOCUMENTS

| | | | |
|---|---|---|---|
| 4,249,297 | 2/1981 | Waters | 227/147 X |
| 4,282,615 | 8/1981 | Tom | 227/156 X |
| 4,314,429 | 2/1982 | Casteel et al. | 52/749 X |

*Primary Examiner*—Paul A. Bell
*Attorney, Agent, or Firm*—Richard C. Ruppin

[57] ABSTRACT

Apparatus and method for driving an object such as a nail covered by a deformable member such as a shingle without damage to the latter. Force is applied by means such as a hammer to a force distributing member in engagement with the deformable member. A force receiving member is positioned opposite the force distributing member and the deformable member is positioned between the force distributing and force receiving members. The force is received from the deformable member by the force receiving member and applied to the object to drive it.

7 Claims, 3 Drawing Figures

DRIVING APPARATUS

BACKGROUND OF THE INVENTION

This invention relates to apparatus and a method for driving an object covered by a deformable member and, more particularly, to a tool and a method for resetting loose roofing nails, staples, and other fastening devices covered by shingles without removing the shingles.

Roofing shingles are commonly affixed to plywood sheathing on the roof of a building by driving nails through the shingles into the plywood. The shingles are laid in an overlapping progression such that the nails through each shingle are covered by an overlapped portion of the next shingle nailed to the roof. Thus, each nail is covered so that water cannot flow through the nail hole in the shingle and plywood sheet. This mode of attachment is used for virtually all types of shingles nailed to pitched roofs including shingles made of wood, shingles containing fiberglass, and the most common shingle material, asphalt impregnated felt.

Roof coverings of such shingles typically have a useful life of fifteen to twenty years depending on the weight and quality of the shingles, the pitch of the roof and weather conditions. However, in many instances, well prior to the deterioration of the shingles to the point requiring their replacement, the nails holding the shingles to the roof will loosen and permit movement of the shingles by wind. The result is poor appearance of the roof, increased wear to the shingles and, frequently, blowing of the shingles from the roof to thereby necessitate their early replacement. The nail loosening problem is difficult to remedy due to the inaccessibility of the nails under the shingles. The shingles will frequently break if they are bent back to permit redriving of the nails. Also, due to the deformability of the shingles, particularly asphalt type shingles, striking the shingle at a point immediately over the nail head to set or redrive the nail will result in rupture of the shingle in the vicinity of the nail or breaking of the entire shingle.

SUMMARY OF THE INVENTION

It is a principal object of the present invention to provide an apparatus and method for driving an object covered by a deformable member such as a shingle by applying a distributed force to the deformable member.

Another object of the invention is to provide a tool and method for setting a nail or other shingle fastener covered by a shingle without damaging the shingle.

The objectives of the invention are accomplished by the use of an apparatus which acts as a force transferring means and includes a first member for receiving force from a driving means, typically in a sharp, impact form, and distributing and applying the force to a deformable member, a second member separated from the first member by the deformable member and positioned opposite the first member for receiving the force from the deformable member and applying the force to an object to be driven or set. When the apparatus is used specifically as a tool for resetting nails under shingles, the driving means will commonly be a hammer or hatchet, the first and second members will each be elongated, relatively flat members positioned opposite each other, the deformable member will be the shingle positioned between the elongated members, and the object will be a nail or staple under the shingle.

BRIEF DESCRIPTION OF THE DRAWINGS

The foregoing and other objects and features of the present invention will be more clearly understood from the following detailed description thereof when read in conjunction with the accompanying drawings in which.

DESCRIPTION OF THE PREFERRED EMBODIMENT

Figure 1:
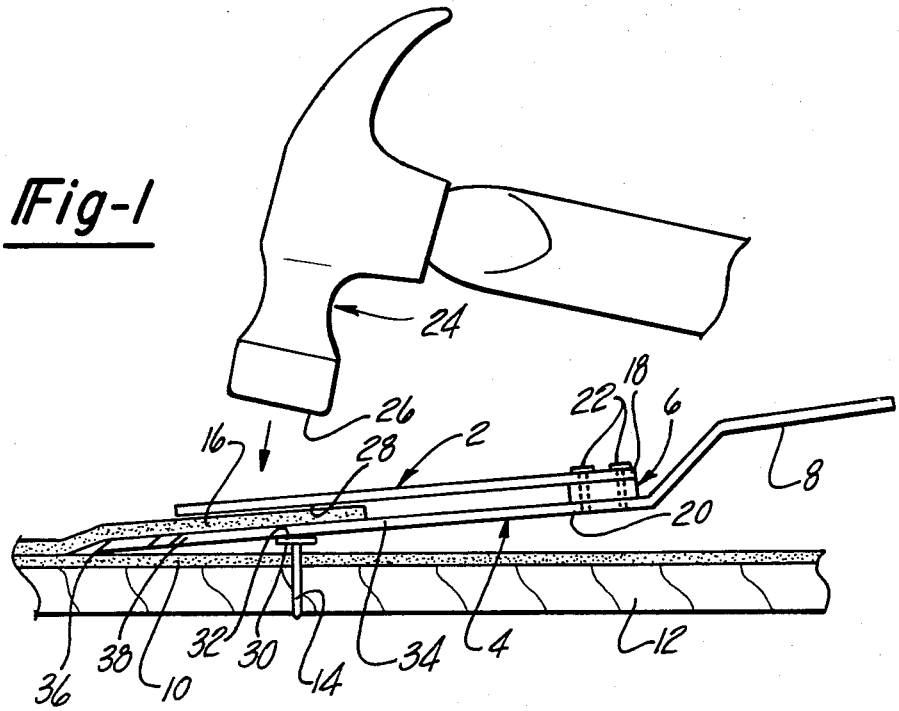
FIG. 1 is an elevation view, partly in cross section, of the invention just prior to the setting of a nail.
Figure 2:
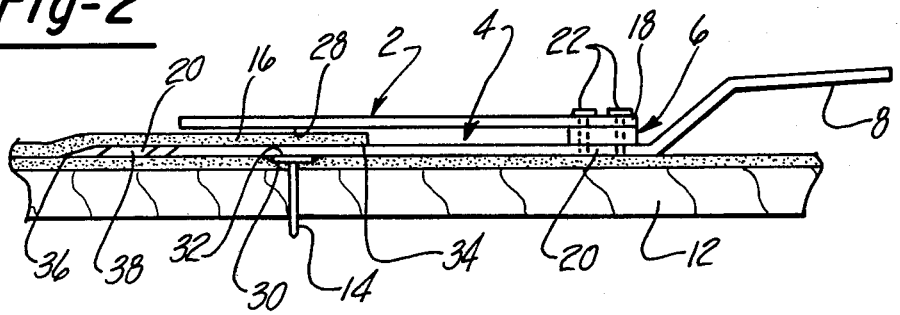
FIG. 2 is an elevation view, similar to FIG. 1, showing the force transferring means of the invention subsequent to the setting of a nail.
Figure 3:
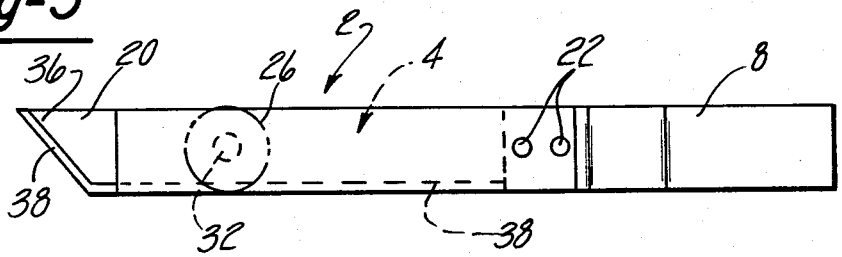
FIG. 3 is a plan view of the force transferring means of the invention.

With reference to the drawings, there is shown a force transferring apparatus which functions as a nail setting tool when used to reset roofing nails on shingled roofs. The apparatus comprises a first elongated relatively flat, plate member 2 and a second elongated, relatively flat, plate member 4 which is somewhat longer than the first member 2 and is positioned opposite the member 2. Both of the members 2 and 4 may be of a hard, rigid material capable of handling considerable stress, such as steel. The members 2 and 4 respectively have ends 18 and 20 between which is positioned a spacer 6 for maintaining the members 2 and 4 spaced apart. Rivets 22 hold the first and second members 2 and 4 and the spacer 6 together as an integral unit. The spacer 6 may be of any suitable material such as steel, nylon or rubber. A handle 8 extends from the second member 4 for holding and positioning the apparatus. Although the spacer 6 is shown in the drawings as a separate piece, it may be formed integrally with either member 2 or 4, or with handle 8. The force transferring apparatus is illustrated in FIGS. 1 and 2 positioned to function as a nail setting tool for a shingled roof. A shingle 10 is shown affixed to a plywood roof sheet 12 by a nail 14. The nail setting tool is positioned such that it is directly over the nail 14 and a shingle 16, which overlaps shingle 10 and normally covers nail 14, is between the first and second members 2 and 4. A driving means such as hammer 24 is illustrated in FIGS. 1 and 3 just prior to impacting the nailing setting tool.

With continuing reference to FIG. 1, the driving means or hammer 24 has a contact area 26 through which its driving force is applied to the first member 2. The contact area 26 is also shown in phantom lines in FIG. 3. The first member 2 has a surface 28 which engages the shingle 16, either at the time the shingle 16 is positioned between the members 2 and 4 or at the time the hammer 24 impacts the member 2, depending on the thickness of the shingle 16. As the drawings indicate, the surface 28 of member 2 is larger than the contact area 26 of hammer 24. The nail 14 includes a head 30 having a driving surface or contact area 32 through which it receives its driving or setting force from the member 4. The member 4 has a surface 34 in engagement with the shingle 16 for receiving driving force from the shingle 16. As the drawings indicate, the surface 34 of member 4 is larger than the contact area 32 of the nail head 30.

In operation, the second member 4 of the nail setting tool is first inserted between shingles 10 and 16. To assist in the insertion of the member 4 in this manner, it is provided with a pointed end 36 and a beveled edge 38. The tool is then positioned such that the shingle 16 is between the members 2 and 4 and the member 4 overlies and is in engagement with the contact area 32 of the nail 14. Consequently, of course, the member 4 will also overlie the nail 14. Force is then applied to the member 2 by impacting the member 2 with the hammer 24 in the direction of the nail 14. The member 2, due to its large surface 28 compared to the contact area 26 of the hammer 24, distributes the force over the surface of the shingle 16 such that the force passes toward the nail 14 through a cross-section of the shingle 16 relatively larger than would be the case if the hammer 24 impacted the shingle 16 directly. The force is received by the member 4 and, since the surface 34 of the member 4 is larger than the contact area 32 of the nail 14 in engagement with the member 4, the distributed force is concentrated on the contact area 30 to drive or reset the nail 14 into the plywood sheet 12. The reset nail in plywood sheet 12 is shown in FIG. 2.

In utilizing the force transferring means or nail setting tool in the foregoing described manner, the driving force can be transferred through deformable materials without damage to the materials or without causing deformation to the materials visible to the human eye.

It will be understood that the foregoing description of the present invention is for purposes of illustration only, and that the apparatus and method disclosed herein are susceptible to a number of modifications or changes and other uses, none of which entail any departure from the spirit and scope of the present invention as defined in the hereto appended claims. For example, the deformable member may be of any high viscosity material having an identifiable shape. Also, the invention has a wide variety of applications others than nail setting.

What is claimed is:

1. The combination of apparatus for driving an object utilizing driving means for applying force, the object having a contact area through which force is received by the object and the driving means having a contact area through which force is applied by the driving means, comprising:

a deformable member positioned between the driving means and the object; and force transferring means including, first means positioned between the driving means and the member for receiving force from the driving means through the contact area of the latter and having a surface engageable with the member for transferring said force to the member, said surface being larger than the contact area of the driving means; and second means positioned opposite the first means, said member being positioned between the first and second means, the second means being in engagement with said object and having a surface in engagement with the member which is larger than the contact area of the object for receiving, through the member, the force applied to the first means and applying the force to the object.

2. The combination according to claim 1 wherein the second means is a plate having a length, said plate being relatively flat along the entire length opposite the first member.

3. The combination according to claim 1 wherein the first and second means each have a length on opposite sides of said member, said lengths being parallel along their entire portions on the opposite sides of the member.

4. A method for driving an object having a force receiving surface with a driving means having a force applying surface through a deformable member positioned between the object and the driving means, comprising the steps of:

applying driving force with the surface of the driving means to the member in the direction of the object;

distributing the force over an area of a force receiving surface of the member that is larger than the force applying surface of the driving means;

transmitting the force through the member;

receiving the force transmitted through the member over a force applying surface of the member that is larger than the force receiving surface of the object; and concentrating the force from the force applying surface of the member on the force receiving surface of the object to thereby drive the object.

5. The method according to claim 4 wherein the member contains a fluid and the force transmitting step comprises transmitting the force through the fluid.

6. The method according to claim 4 wherein the driving force is applied to the member directly opposite the force receiving surface of the object.

7. The method according to claim 4 wherein the force is transmitted through only a single member.

* * * * *